United States Patent [19]

Pascal

[11] 4,028,768

[45] June 14, 1977

[54] RETRACTABLE BRUSH

[76] Inventor: Brian W. Pascal, 182 Northcoat Drive, Pincourt, Quebec, Canada

[22] Filed: Jan. 14, 1976

[21] Appl. No.: 649,160

[30] Foreign Application Priority Data

Nov. 6, 1975 Canada ..... 239268

[52] U.S. Cl. ..... 15/203; 15/184; 132/119; 132/123

[51] Int. Cl.[2] ..... A46B 9/10; A46B 17/06

[58] Field of Search ..... 15/184, 185, 169, 201, 15/203; 132/119–123

[56] References Cited

UNITED STATES PATENTS

| | | | |
|---|---|---|---|
| 2,486,203 | 10/1949 | Pieper | 15/203 |
| 2,981,965 | 5/1961 | Kaye et al. | 15/203 |
| 3,947,914 | 4/1976 | Jacoby | 15/203 |

*Primary Examiner*—Peter Feldman
*Attorney, Agent, or Firm*—Watson, Cole, Grindle & Watson

[57] ABSTRACT

There is provided a collapsible brush structure comprised of a body portion, a bristle bed movable in the longitudinal direction of the body, a plurality of bristles being set in the bristle bed, and means for moving the bristle bed between first and second positions whereby the bristles are in an erect condition and a flattened condition respectively. A feature of the structure is the provision of rotatable guide means through which the bristles pass, the guide means functioning to clean the bristles whenever they are moved from the erect condition to the flattened condition. The brush structure is a very compact one and can easily be carried in a pocket of the user.

13 Claims, 12 Drawing Figures

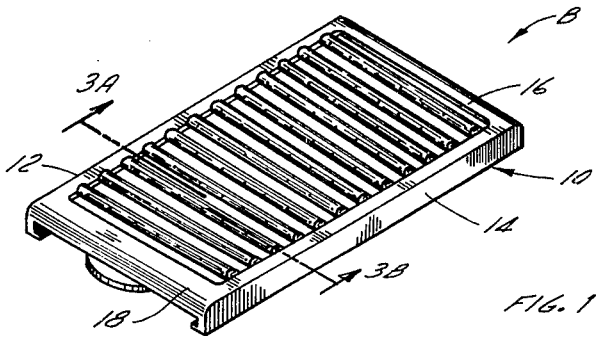
FIG. 1
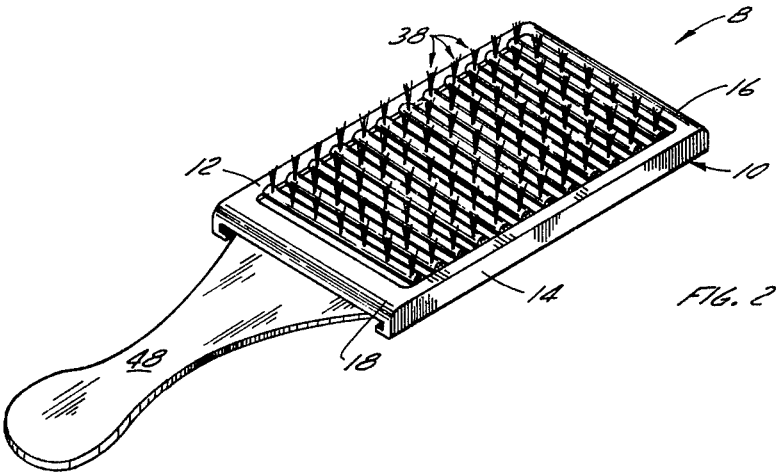
FIG. 2
FIG. 3A
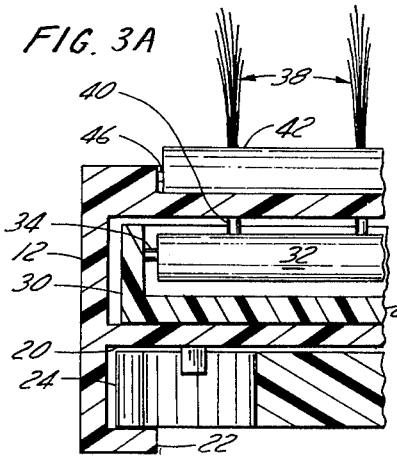
FIG. 3B
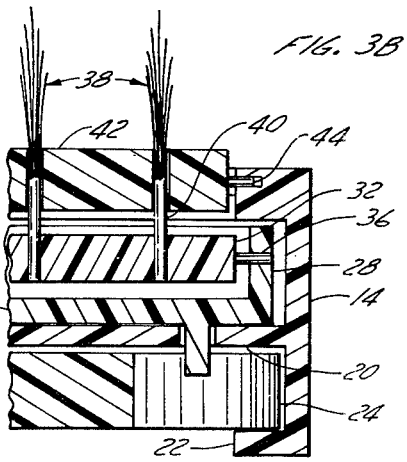

RETRACTABLE BRUSH

The present invention relates to brushes or like devices and more particularly, relates to a folding or collapsible brush.

The art dealing with brushes of the folding or collapsible type is basically an old one and many suggestions have been made in the prior art as to suitable structures for such devices. For example, U.S. Pat. No. 1,889,182 issued Nov. 29, 1932, teaches a brush provided with bristle carrying members which are collapsible within a case and extensible by the opening of the case; a sliding hinge mechanism connects the case and a cover is used for controlling the bristle clips causing the bristles to fold or collapse as desired. Still further, it has been proposed in the art to use proposed various rack and pinion, lever linkage and lever cam systems, for moving the bristle mounts between the "open" and "closed" conditions. Also, to overcome what are alleged to be relatively complicated mechanisms, it has been suggested to provide surfaces on the bristle mounts eccentric to the axis of the trunnions. Still further, proposals have been made to employ devices in which the bristle carrying elements are expandable and contractable laterally.

Despite the many proposals in the art, folding or collapsible brushes have never gained a wide degree of acceptance possibly due to their relatively complicated mechanisms. In this respect, many of the proposals previously advanced have a folding mechanism which is such that relatively short bristles must be employed in order that the bristles, in their collapsed state, do not occupy excessive space thereby defeating the purposes of having a collapsible or folding brush. The only other alternative is to provide a folding brush having long bristles but wherein the spacing between the traversely extending rows of bristles is substantially larger than normal.

It is therefore an object of the present invention to provide a collapsible or folding brush structure having a relatively uncomplicated and reliable construction.

It is a further object of the present invention to provide a folding brush structure wherein the bristles of the brush are subjected to a cleaning action whenever the brush is transformed from its usable condition to a collapsed condition.

In one aspect of the present invention, there is provided a retractable brush structure comprising a body portion, a movable bristle bed within said body portion, a plurality of bristles secured to said bristle bed, means for moving said bristle bed between first and second positions whereby said bristles are in an erect condition and a flattened condition respectively, and guide means, said guide means having a plurality of apertures therein, each of said apertures being sized to snugly receive at least one bristle.

In a further aspect of the invention, there is provided a self-cleaning retractable brush structure comprising a substantially rectangular body portion having a pair of opposed side walls and a pair of opposed end walls, a bristle bed comprised of a base, a pair of opposed side walls, and a plurality of bristle receiving members extending between said pair of opposed side walls of said bed and being rotatably turnable therein, a plurality of bristles set in said bristle receiving members, a plurality of guide members extending between said pair of opposed side walls of said body portion and being fixedly and rotatably turnable therein, there being one guide member for each bristle receiving member, a plurality of apertures passing through each of said guide members, each aperture having at least one bristle passing therethrough in a snugly fitting relationship, and means for moving said bed in the longitudinal direction of said body portion, the movement of said bristle bed causing a rotatable movement of both said bristle receiving members and said guide members, at least a portion of said bristles being withdrawn through said guide members thereby cleaning said bristles.

In greater detail, the body portion of the collapsible brush may be formed of any suitable material — such as wood, various metallic materials, plastic materials such as nylon, polypropylene, etc., and the like. Similarly, the shape of the body portion may assume any desired; for the sake of convenience herein, reference will be made to a brush of a rectangular configuration. However, it will be understood by those knowledgable in the art that other configurations may equally well be employed, for example, circular, elliptical, square, various irregular shapes, etc.

The brush structure includes a movable bed for receiving and holding the bristles. The bristle bed may, if so desired, comprise a single piece of material having the bristles set therein in a manner normally associated with conventional type brushes. The bristle bed is movable with respect to the body portion and thus, means are provided within the body portion for supporting the bristle bed and allowing the same to move longitudinally of the body portion.

In a preferred embodiment, the bristle bed may comprise a substantially U-shaped component having bristle receiving members extending between the walls thereof. The reasons for this preferred configuration will be discussed in greater detail hereinafter.

The bristles per se are set in the bristle bed or other bristle receiving component in a conventional manner. It will be understood that the use of the term "bristle" encompasses all bristles whether they be monofilament or multifilament. Thus, in the sense employed herein, a single bristle may have a number of filaments comprising the same.

As above-mentioned, a preferred embodiment employs a somewhat U-shaped bristle bed with bristle receiving members extending transversely between the proposed side walls. These bristle receiving members are preferably rotatably journalled in the side walls. However, when employing a plurality of rotatable transversely extending bristle receiving members, it is not necessary that any one member extend the complete transverse width of the bristle bed. Rather, the structure may be such that the bristle bed contains a plurality of ribs extending parallel to the side walls whereby, in effect, the bristle bed becomes a series of parallel U-shaped segments. By so doing, any transverse row of bristles may be arranged so as to be offset with respect to each other.

The brush of the present invention also preferably includes a handle portion. Many different structures are available for a handle; preferably, the handle is "self-storing" within the body portion of the brush.

In a preferred embodiment, the handle is adapted to slidingly fit within the body portion. To this end, a pair of grooves in the side walls of the body portion may be provided. Even more preferably, the handle may act as a means for moving the bristle bed between its erected and collapsed conditions. Thus, for example, the bristle bed may have two or more lugs or pins projecting downwardly therefrom which will be engaged by the handle to move the bristles to the desired position. The operation of such an embodiment will become evident in the detailed description.

A feature of the collapsible or folding brush of the present invention is the provision of a plurality of guide means which also function as a cleaning system for the bristles. Preferably, the guide means comprise a plurality of transversely extending guide members rotatably journalled in the side walls of the body portion. The guide members are rotatably journalled in the side walls and have a plurality of apertures extending therethrough. Each of the apertures is adapted to receive a bristle extending from the bristle receiving members. Thus, for each bristle receiving member, there is a corresponding guide member.

As aforementioned, the guide members are rotatable with respect to the body portion. When the bristles are moved from an erect of "in use" condition to the collapsed state, the longitudinal movement of the bed causes the guide members to rotate and a subsequent retraction of the bristles through the apertures. Due to the snug fit of the bristles therein, a cleaning action will result whereby any hairs or other foreign materials on the bristles will substantially remain on the guide members from where it may be removed.

In one particular aspect of the present invention, there is provided an aperture for each bristle which is of a monofilament type. As will readily be appreciated, the cleaning action of the guide members will, in this case, be extremely efficient. However, it will be understood that each aperture may accommodate a bristle of a multifilament type and still achieve the desired cleaning action.

Having thus generally described the invention, reference will be made to the accompanying drawings illustrating embodiments thereof, and in which:

FIG. 1 is a perspective view of one embodiment of a collapsible brush of the present invention in a collapsed condition;

FIG. 2 is a perspective view of the brush of FIG. 1 in its usable condition;

FIG. 3A is a cross-sectional view taken along the line 3A of FIG. 1 between two rows of transversely extending bristles;

FIG. 3B is a cross-sectional view taken along the line 3B of FIG. 1;

Figure 4:
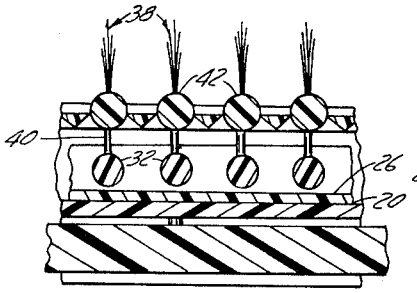
FIG. 4 is a partial longitudinal section of FIG. 2 illustrating the bristles in their erect condition.

Referring to the drawings in greater detail, and by reference characters thereto, there is illustrated in FIGS. 1 to 7 a first embodiment of a brush of the collapsible or self-storing bristle type generally designated by reference character B.

Brush B is shown as having a generally rectangular configuration with a body portion 10 comprised of a pair of longitudinally extending side walls 12, 14 interconnected by transversely extending end walls 16, 18. As will be seen from FIGS. 3A and 3B, body portion 10 further includes a plate-like member 20 connecting side walls 12 and 14. At the bottom edge of side walls 12 and 14 are flanges 22 which, with the side walls and plate 20, define a pair of opposed grooves 24 within the body.

The bristle bed, in the embodiment of FIGS. 1 to 7, has a somewhat U-shaped configuration comprised of a base 26 and opposed side walls 28 and 30. A plurality of bristle receiving members 32 are journalled by means of pins 34 and 36 in walls 30 and 28 respectively. Bristles 38 encased in a sheath 40 are "set" in bristle-receiving members 32.

Extending parallel to the bristle-receiving members 32 are a plurality of guide members 42 which are journalled in side walls 12 and 14 by pins 46 and 44, respectively, such that they are freely rotatable.

Figure 6:
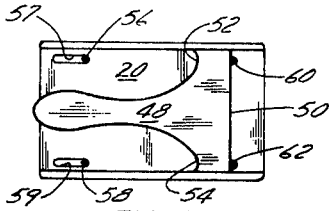
FIG. 6 is a bottom view of the brush of FIG. 1.
Figure 7:
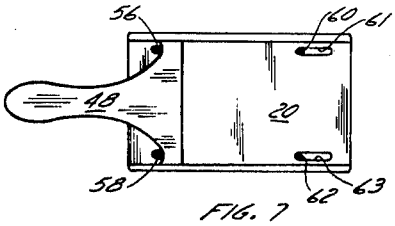
FIG. 7 is a bottom view of the brush of FIG. 2.

A handle portion 48 is provided which is slidably engaged in grooves 24 and which handle portion, at one extremity thereof, has an end wall 50 with the opposed end having pin engaging means 52 and 54 as illustrated in FIG. 6. Depending from base 26 of the bristle bed are two pairs of lugs or pins 56, 58 and 60, 62. These extend through plate 20 with cut-outs or apertures 57, 59, 61 and 63 being present therein.

Brush B, when in its usable condition, i.e., when the bristles are erect, is illustrated in FIGS. 2, 3A, 3B, 4 and 7. When it is desired to collapse the brush or "store" the bristles, handle 48 is slid along in groove 24 in the direction indicated by arrow 68. As a result thereof, wall 50 will engage pins or lugs 60, 62, which are connected to base 26 of the bristle bed. As a result, the bristle bed will move as indicated by arrow 66. The longitudinal movement of the bristle bed causes a rotational movement of bristle receiving members 32 (see arrow 70) and also, a rotatable movement of guide members 42 (see arrow 64). Consequently, bristles 30A are withdrawn through the apertures in guide members 42. Bristles 38, being snugly fit within the apertures, are subjected to a cleaning action.

Thus, as may be seen from FIG. 1, a compact structure is achieved wherein the bristles are stored within the body portion of the brush as is the handle portion.

Figure 5:
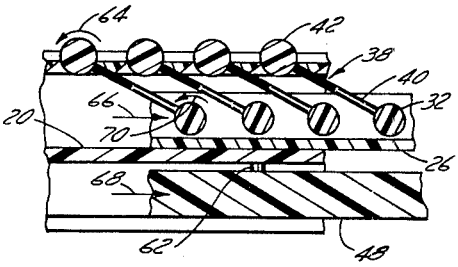
FIG. 5 is a partial longitudinal section of FIG. 1 showing the retracting movement of the bristles.

When it is desired to use the brush, handle 48 is withdrawn from grooves 24. This withdrawal motion will cause pin engaging means 52 and 54 of the handle to engage lugs or pins 56, 58 and move the same along slots 57, 59 respectively. The bed will then slide in the left-hand direction (as seen in FIGS. 4 and 5) causing the bristles 38 to pass through the apertures in guide members 42 to an erect condition.

If desired, means may be provided for locking handle 48 in a desired position to maintain the bristles in an erect condition. Any number of locking arrangements may be used including means for frictionally holding the same, clips, etc.

Bristles 38 are illustrated as being of a multifilament type; if so desired, monofilament bristles may equally well be employed, and the bristles may be of any suitable material, either natural or synthetic, such materials being well known to those skilled in the art.

It will be noted that in the illustrated embodiment, each guide member 42 has a bristle-receiving member 32 associated therewith and which, when the brush is in its usable condition, are in a perpendicular line with respect to the bristle bed base 26. If desired, the arrangement may be such that the bristles do not extend perpendicularly, but rather at an angle to the bristle bed base.

Referring to FIGS. 8 to 11, an alternative embodiment of a self-storing brush is illustrated. In many respects, the brush of FIGS. 8 to 11 has features similar to that discussed above and hence, like reference numerals with a prime (′) are employed.

Figure 8:
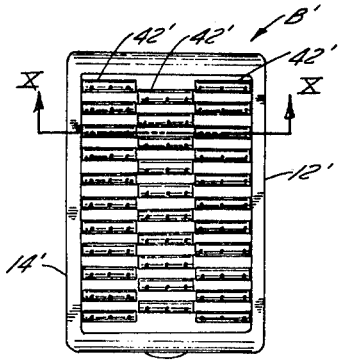
FIG. 8 is a top view of a further embodiment of the brush according to the present invention.
Figure 9:
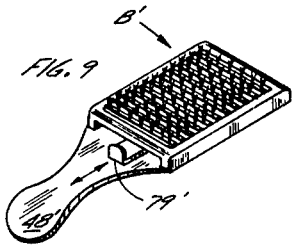
FIG. 9 is a perspective view of a further embodiment of the collapsible brush.
Figure 11:
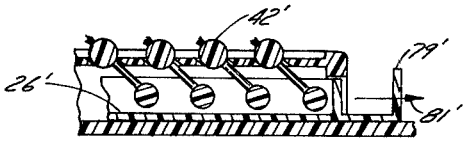
FIG. 11 is a partial longitudinal section of the brush embodiment of FIG. 9.
Figure 10:
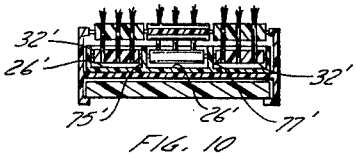
FIG. 10 is a cross-sectional view taken along the line X—X of FIG. 8.

As may be seen from FIG. 8, brush B′ has a plurality of guide members 42′ extending between side walls 12′, 14′. Similarly, a plurality of bristle-receiving members 32′ are used. By so doing, the staggered or offset relationship of the bristles with respect to each other is achieved.

The use of a plurality of bristle-receiving members 32′ may be achieved by having ribs 75′, 77′, extending upwardly from bristle bed base 26′.

Instead of using handle 48′ as a means of raising and lowering the bristles, bristle bed base 26′ may have an extension 79′ secured thereto whereby a movement of the same causes the raising and lowering of the bristles as indicated by arrow 81′. As in the previously described embodiment, the friction of extension 79′ with the base or handle may be sufficient to retain the bristles in the desired position. Alternatively, means may be provided to retain extension 79′ in the desired position.

It will be understood that the above-described embodiments are only illustrative of the invention and changes and modifications may be made thereto without departing from the spirit and scope of the invention. As will be seen from the above description, the collapsible brush of the present invention allows for maximum compactness as both the bristle and the handle are retractable. The brush structure may be employed for any number of uses, for example, hair brushes, clothes brushes, shoe shine brushes, household hand brushes, floor brooms, tooth brushes, etc. So further, if desired, the withdrawal of the bristles through the apertures of the guide and cleaning members may function to treat the bristles in a desired manner.

I claim:

1. A self-cleaning retractable brush structure comprising a body portion, a movable bristle bed within said body portion, a plurality of bristle members secured to said bristle bed, rotatably mounted guide members, said guide members having a plurality of apertures therein, each of said apertures being sized to snugly receive at least one bristle member, and means for moving said bristle bed from a first position wherein said bristle members are in an erect condition, to a second position wherein said bristle members are in a retracted condition with the free end of each bristle member being within its aperture, such that said bristle members are drawn through said apertures while said guide members rotate whereby an extraneous material is removed from the bristle members and remains on a surface of said guide members.

2. The structure of claim 1 wherein said bristle bed comprises a plurality of elongated rotatable bristle-receiving members extending transversely to the direction of movement of said bristle bed and said guide members comprise cylindrical members.

3. The structure of claim 2, wherein said guide members comprise a plurality of fixed elongated freely rotatable guide members extending transversely to the direction of movement of the bristle bed, each of said guide members having a plurality of apertures extending therethrough adapted to receive a bristle of a monofilament or multifilament type.

4. The structure of claim 3 further including a handle slidable within grooves of said body portion.

5. The structure of claim 4 wherein said handle includes means associated therewith to cooperatively engage means on said bristle bed to move said bristle bed between said first and second positions.

6. The structure of claim 3 wherein each of said bristle receiving members and guide members extends substantially the complete transverse width of said body portion.

7. The structure of claim 3 wherein each of said guide members and bristle receiving members extends only a portion of the complete width of said body portion.

8. The structure of claim 3 wherein each of said bristle member comprises a monofilament bristle.

9. The structure of claim 3 wherein each of said bristle member comprises a multifilament bristle.

10. A self-cleaning retractable brush structure comprising rectangular body portion having a pair of opposed side walls and a pair of opposed end walls, a bristle bed comprised of a base, a pair of opposed side walls, and a plurality of bristle-receiving members extending between said pair of opposed side walls of said bed and being rotatably turnable therein, a plurality of bristles set in said bristle-receiving members, a plurality of guide members extending between said pair of opposed side walls of said body portion and being fixedly and rotatably turnable therein, there being one guide member for each bristle-receiving member, a plurality of apertures passing through each of said guide members, each aperture having at least one bristle passing therethrough in a snugly fitting relationship, and means for moving said bristle bed in the longitudinal direction of said body portion from a first position wherein said bristles are in an erect condition to a second position wherein said bristles are in a retracted condition with the free end of each bristle being within its aperture, such that said bristles are drawn through said apertures while said guide members rotate whereby any extraneous material is removed from the bristles and remains on a surface of said guide members.

11. The structure of claim 10 further including a handle.

12. The structure of claim 11 wherein said base of said bristle bed has lugs secured thereto, said handle adapted to engage said lugs whereby a movement of said handle causes a movement of said bristle bed.

13. The structure of claim 10 wherein said bristles are selected from the group consisting of monofilament types and multifilament types.

* * * * *